US010369431B2

(12) United States Patent
Nakamura et al.

(10) Patent No.: US 10,369,431 B2
(45) Date of Patent: Aug. 6, 2019

(54) GOLF CLUB HEAD

(71) Applicant: DUNLOP SPORTS CO. LTD., Kobe-shi, Hyogo (JP)

(72) Inventors: Takashi Nakamura, Kobe (JP); Daisuke Kohno, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/299,890

(22) Filed: Oct. 21, 2016

(65) Prior Publication Data

US 2017/0113103 A1 Apr. 27, 2017

(30) Foreign Application Priority Data

Oct. 23, 2015 (JP) ..... 2015-208554

(51) Int. Cl.
*A63B 53/04* (2015.01)

(52) U.S. Cl.
CPC .... *A63B 53/047* (2013.01); *A63B 2053/0408* (2013.01); *A63B 2053/0416* (2013.01); *A63B 2053/0433* (2013.01); *A63B 2053/0458* (2013.01); *A63B 2053/0491* (2013.01)

(58) Field of Classification Search
CPC ..... A63B 53/047; A63B 2053/0408; A63B 2053/0416; A63B 2053/0458; A63B 2053/0433; A63B 2053/0491; A63B 53/0475
USPC ..... 473/324–350, 287–292
See application file for complete search history.

(56) References Cited

U.S. PATENT DOCUMENTS 5,303,922 A * 4/1994 Lo ..... A63B 53/04 473/330
5,683,310 A * 11/1997 Chen ..... A63B 53/04 473/349
7,144,337 B2 * 12/2006 Hirano ..... A63B 53/047 473/342
7,235,023 B2 * 6/2007 Sugimoto ..... A63B 53/047 473/291
7,431,665 B2 * 10/2008 Sugimoto ..... A63B 53/047 473/342
7,435,189 B2 * 10/2008 Hirano ..... A63B 53/047 473/342
7,544,136 B2 * 6/2009 Tsai ..... A63B 53/047 473/342

(Continued)

FOREIGN PATENT DOCUMENTS

JP 2691496 B2 12/1997
JP 3116162 U 12/2005

*Primary Examiner* — Sebastiano Passaniti
(74) *Attorney, Agent, or Firm* — Birch, Stewart, Kolasch & Birch, LLP

(57) ABSTRACT

A head includes a head body and a face plate fixed to the head body. The face plate includes a plate front surface, a plate back surface, and a plate side surface. The plate back surface includes a center of figure. The head body includes a receiving surface which supports the plate back surface from rear. An outer peripheral edge part of the plate back surface includes a projection part which abuts on the receiving surface. If a toe-side region, a top-side region, and a sole-side region of the projection part are defined as a first section, and a heel-side region of the projection part is defined as a second section, then a width of the projection part is varied in the first section.

13 Claims, 18 Drawing Sheets

(56) References Cited

U.S. PATENT DOCUMENTS

| | | | | |
|---|---|---|---|---|
| 7,578,754 | B2 * | 8/2009 | Nakamura | A63B 53/047 473/342 |
| 9,561,412 | B2 * | 2/2017 | Ueda | A63B 53/047 |
| 9,975,016 | B2 * | 5/2018 | Nakamura | A63B 53/047 |
| 10,029,157 | B2 * | 7/2018 | Sugimoto | A63B 53/047 |
| 10,039,966 | B2 * | 8/2018 | Kohno | A63B 60/54 |
| 10,173,107 | B2 * | 1/2019 | Norimura | A63B 53/0475 |
| 2005/0003900 | A1 * | 1/2005 | Sugimoto | A63B 53/047 473/290 |
| 2005/0101406 | A1 * | 5/2005 | Hirano | A63B 53/047 473/342 |
| 2005/0181890 | A1 * | 8/2005 | Huang | A63B 53/04 473/342 |
| 2006/0073912 | A1 * | 4/2006 | Hsieh | A63B 53/04 473/350 |
| 2006/0116219 | A1 * | 6/2006 | Hirano | A63B 53/047 473/350 |
| 2006/0293119 | A1 * | 12/2006 | Hou | A63B 53/047 473/342 |
| 2015/0051013 | A1 * | 2/2015 | Ueda | A63B 53/047 473/342 |

* cited by examiner

GOLF CLUB HEAD

The present application claims priority on Patent Application No. 2015-208554 filed in JAPAN on Oct. 23, 2015, the entire contents of which are hereby incorporated by reference.

BACKGROUND OF THE INVENTION

Field of the Invention

The present invention relates to a golf club head.

Description of the Related Art

There has been known an iron type golf club head including a head body and a face plate attached to the head body. Japanese Patent No. 2691496 discloses a head, wherein a projection engaged with a recess of a face body to fix the face body to a head body is formed by the plastic deformation of a part of the head body.

SUMMARY OF THE INVENTION

The present inventors have found that a non-conventional new structure is allowed in a head to which a face plate is attached. This new structure can exhibit an effect heterogeneous from the effect of the conventional technique.

It is an object of the present invention to provide a golf club head having a structure where a face plate is attached to a head body, and having a new effect.

A preferable golf club head includes a head body and a face plate fixed to the head body. The face plate includes a plate front surface having a hitting face, a plate back surface which is a surface opposite to the plate front surface, and a plate side surface. The plate back surface includes a center of figure. The head body includes a receiving surface which supports the plate back surface from rear. An outer peripheral edge part of the plate back surface includes a projection part which abuts on the receiving surface. If a toe-side region, a top-side region, and a sole-side region of the projection part are defined as a first section, and a heel-side region of the projection part is defined as a second section, a width of the projection part is varied in the first section.

Preferably, the width of the projection part is varied in the sole-side region.

Preferably, the projection part includes a center disposing part including the same position in a toe-heel direction as the center of figure, a heel disposing part located on a heel side with respect to the center of figure, and a toe disposing part located on a toe side with respect to the center of figure. Preferably, a width of the center disposing part is greater than a width of the heel disposing part. Preferably, the width of the center disposing part is greater than a width of the toe disposing part.

Preferably, an average width of the projection part in the sole-side region is different from an average width of the projection part in the top-side region.

Preferably, an average width of the projection part in the sole-side region is smaller than an average width of the projection part in the top-side region.

Preferably, an average width of the projection part in the heel-side region is smaller than an average width of the projection part in the toe-side region.

Preferably, the head satisfies the following (a) and/or (b):

(a) a width of the projection part in the heel-side region is varied, and a portion of which the width is minimal is located below the center of figure; and (b) a width of the projection part in the toe-side region is varied, and a portion of which the width is minimal is located below the center of figure.

DESCRIPTION OF THE PREFERRED EMBODIMENTS

Hereinafter, the present invention will be described in detail according to the preferred embodiments with appropriate references to the accompanying drawings.

In the present application, the following terms are defined.

[Base State]

The base state is in a state where a head is placed at a specified lie angle and real loft angle on a level surface h. In the base state, a center axis line (shaft axis line) of a shaft hole of the head is provided in a perpendicular plane VP1. The perpendicular plane VP1 is a plane perpendicular to the level surface h. In the base state, a face surface (hitting face) is inclined at a real loft angle with respect to the perpendicular plane VP1. The specified lie angle and real loft angle are described in, for example, a product catalog or the like.

[Toe-Heel Direction]

In the head of the base state, a direction of an intersection line between the perpendicular plane VP1 and the level surface h is the toe-heel direction. A toe side and a heel side used in the present application should be based on the toe-heel direction.

[Face-Back Direction]

A direction perpendicular to the toe-heel direction and parallel to the level surface h is the face-back direction. A face side and a back side used in the present application should be based on the face-back direction.

[Front-Rear Direction]

A direction perpendicular to the hitting face is defined as the front-rear direction. In other words, a normal direction of the hitting face is defined as the front-rear direction. Front and rear used in the present application should be based on the front-rear direction.

[Up-Down Direction]

A direction perpendicular to the toe-heel direction and parallel to the hitting face is the up-down direction. Above and below used in the present application should be based on the up-down direction.

[Vertical Up-Down Direction]

A direction of a straight line perpendicular to the level surface his the vertical up-down direction. Vertically above and vertically below used in the present application should be based on the vertical up-down direction.

Figure 1:
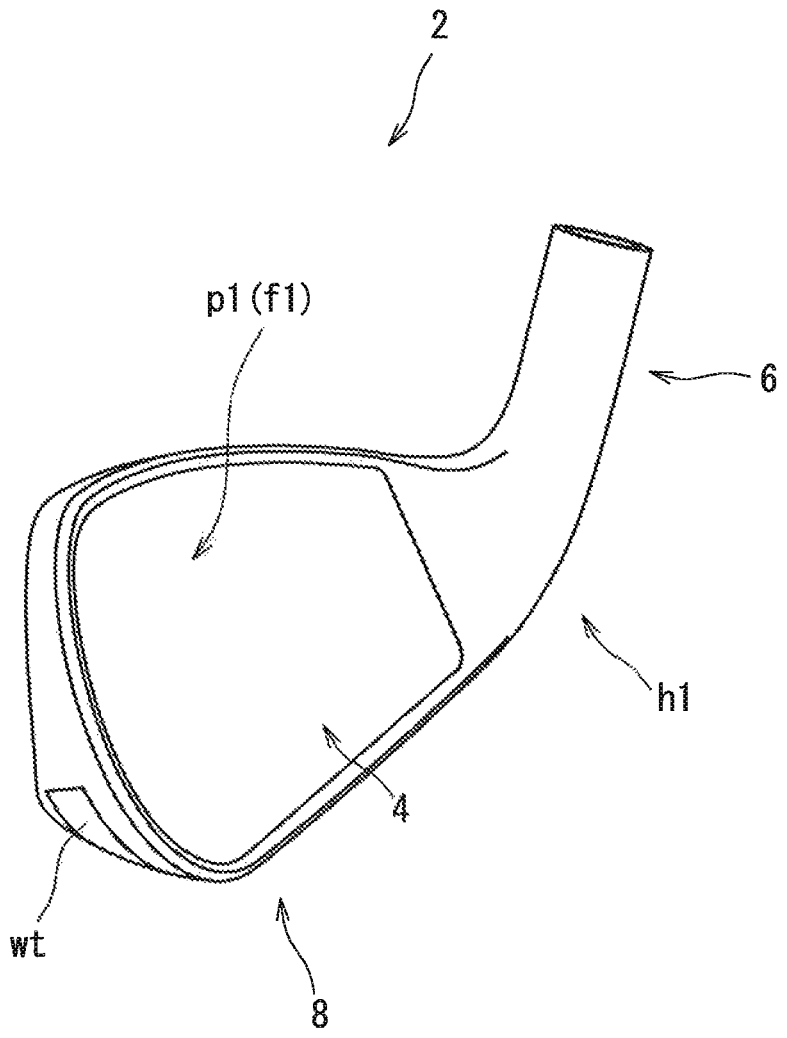
FIG. 1 is a perspective view of a golf club head of a first embodiment.
Figure 2:
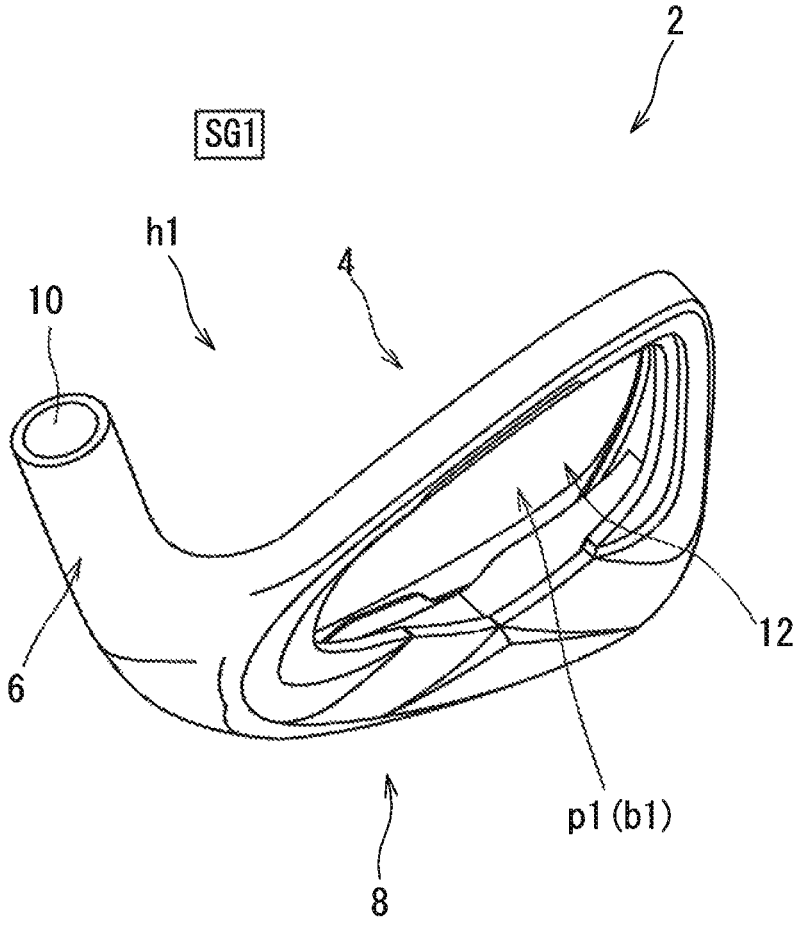
FIG. 2 is a perspective view showing the back surface of the head of FIG. 1.
Figure 3:
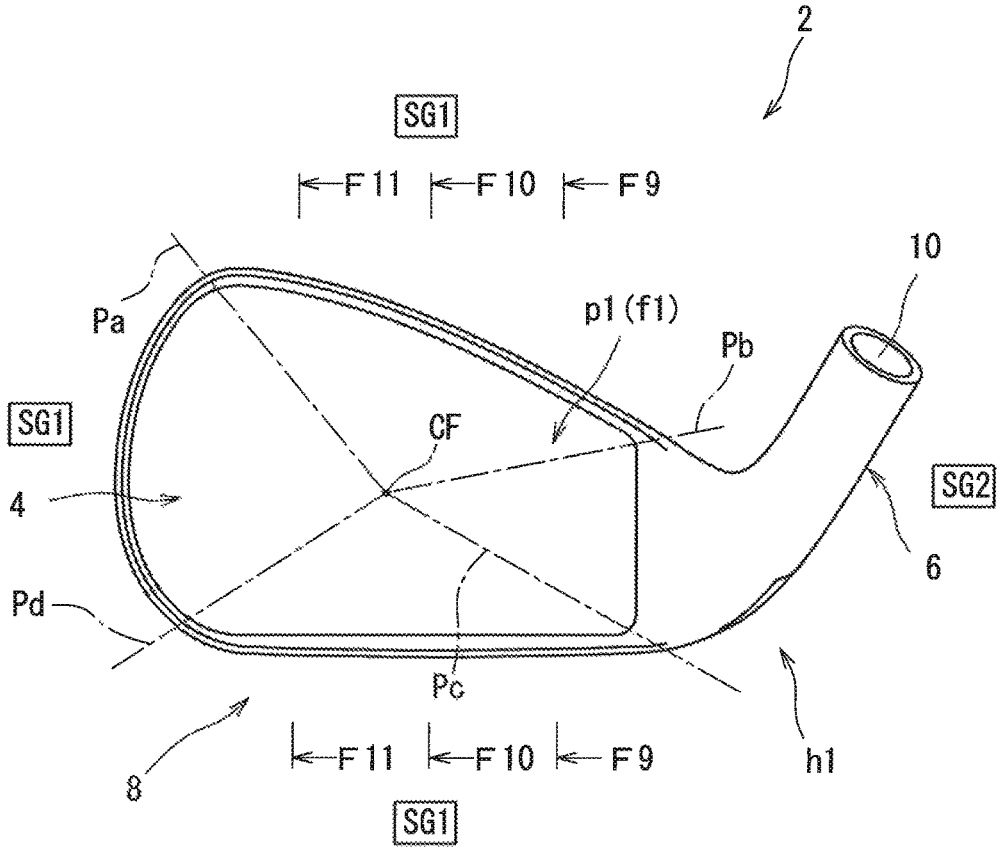
FIG. 3 is a front view of the head of FIG. 1.
Figure 4:
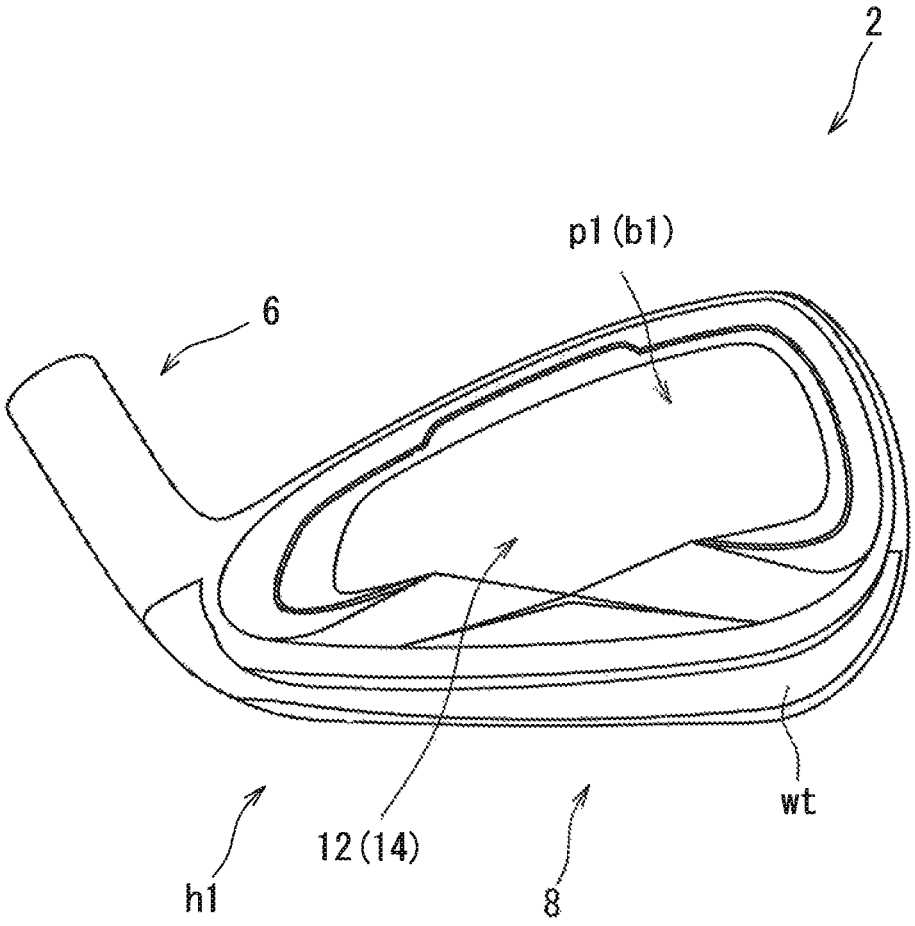
FIG. 4 is a back view of the head of FIG. 1.

FIG. 1 is a perspective view of a golf club head 2 according to a first embodiment of the present invention when the golf club head 2 is seen from an obliquely front side. FIG. 2 is a perspective view of the head 2 when the head 2 is seen from an obliquely rear side. FIG. 3 is a front view of the head 2. FIG. 3 is a front view of the hitting face. FIG. 4 is a back view of the head 2.

The head 2 includes a face 4, a hosel 6, and a sole 8. The hosel 6 has a hosel hole 10. The face 4 is the hitting face. Although face grooves is formed in the surface of the face 4, the description of the face grooves is omitted. A weight member wt is disposed in the sole 8. The head 2 is an iron type golf club head.

A back cavity 12 is provided on a side opposite to the face 4. The head 2 is a cavity back iron.

The head 2 includes a head body h1 and a face plate p1 fixed to head body h1. The head body h1 is made of a metal. In the present embodiment, the head body h1 is made of stainless steel. The face plate p1 is made of a metal. In the present embodiment, the face plate p1 is made of a titanium-based metal. The titanium-based metal means pure titanium or a titanium alloy. The materials of the head body h1 and face plate p1 are not limited.

The titanium alloy is an alloy containing 50% by weight or greater of titanium. Examples of the titanium alloy include α titanium, αβ titanium, and β titanium. Examples of the α titanium include Ti-5Al-2.5Sn and Ti-8Al-1V-1Mo. Examples of the αβ titanium include Ti-6Al-4V, Ti-6Al-2Sn-4Zr-6Mo, Ti-6Al-6V-2Sn, and Ti-4.5Al-3V-2Fe-2Mo. Examples of the β titanium include Ti-15V-3Cr-3Sn-3Al, Ti-20V-4Al-1Sn, Ti-22V-4Al, Ti-15Mo-2.7Nb-3Al-0.2Si, and Ti-16V-4Sn-3Al-3Nb. Examples of the pure titanium include industry pure titanium. Examples of the industry pure titanium include pure titanium of type 1, pure titanium of type 2, pure titanium of type 3, and pure titanium of type 4 which are prescribed by Japanese Industrial Standard.

Preferably, the specific gravity of the face plate p1 is smaller than the specific gravity of the head body h1. The face plate p1 having a smaller specific gravity contributes to the distribution of the weight of the head 2 to the circumference.

Figure 5A:
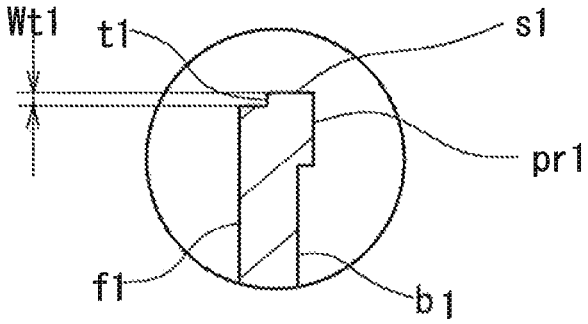
FIG. 5A is a sectional view taken along line 5A-5A in FIG. 5.
Figure 5:
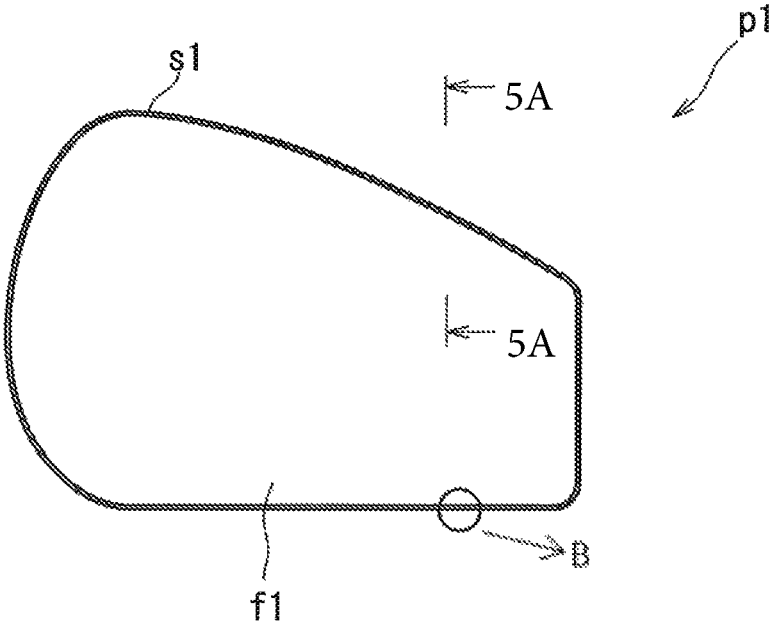
FIG. 5 is a plan view of a face plate according to the head of FIG. 1.
Figure 5B:
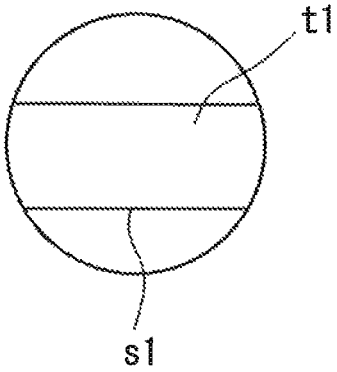
FIG. 5B is an enlarged view of the portion in the circle B in FIG. 5.
Figure 6A:
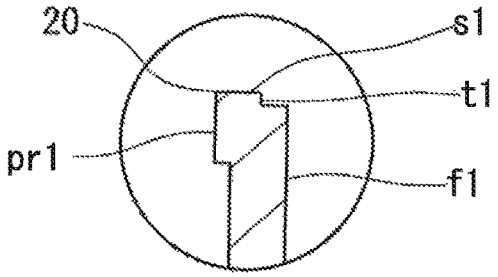
FIG. 6A is a sectional view taken along line 6A-6A in FIG. 6.
Figure 6:
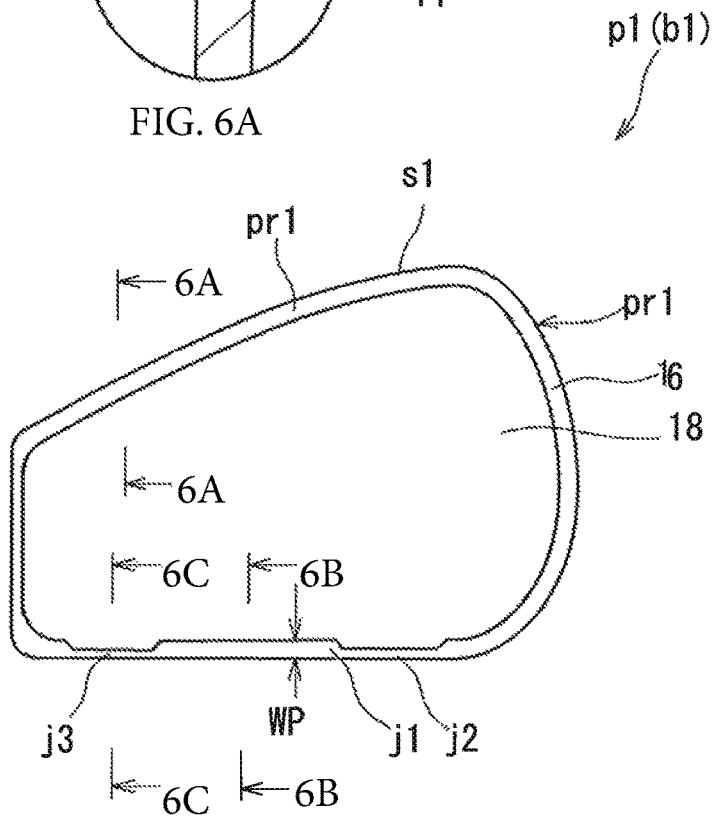
FIG. 6 is a back view of the face plate of FIG. 5.
Figure 6C:
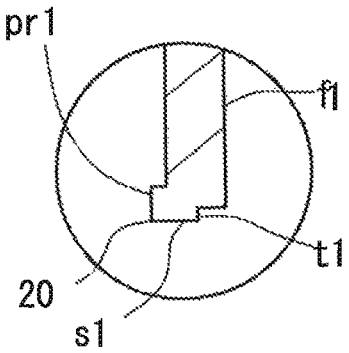
FIG. 6C is a sectional view taken along line 6C-6C in FIG. 6.
Figure 6B:
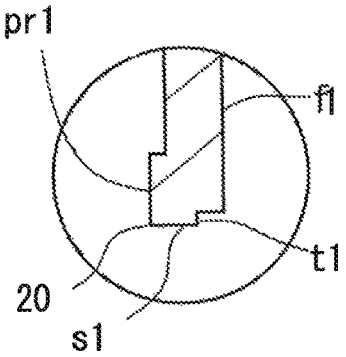
FIG. 6B is a sectional view taken along line 6B-6B in FIG. 6.

FIG. 5 is a plan view of the face plate p1. FIG. 5A is a sectional view taken along line 5A-5A in FIG. 5. FIG. 5B is an enlarged view of the portion in the circle B in FIG. 5. FIG. 6 is a back view of the face plate p1. FIG. 6A is a sectional view taken along line 6A-6A in FIG. 6. FIG. 6B is a sectional view taken along line 6B-6B in FIG. 6. FIG. 6C is a sectional view taken along line 6C-6C in FIG. 6. The face plate p1 includes a plate front surface f1, a plate back surface b1, and a plate side surface s1. The plate front surface f1 includes a hitting face. The hitting face is a plane except for face grooves. The plate back surface b1 is a surface opposite to the plate front surface f1. The plate side surface s1 extends between the plate front surface f1 and the plate back surface b1.

The plate back surface b1 includes an outer peripheral edge part 16 having a circular shape, and an inner side part 18 located on the inner side of the outer peripheral edge part 16. The inner side part 18 is surrounded by the outer peripheral edge part 16. The outer peripheral edge part 16 includes a projection part pr1 which abuts on a receiving surface u1 (to be described later).

The outer peripheral edge part 16 includes a contour line 20 of the plate back surface b1. That is, the outer contour line of the outer peripheral edge part 16 is the contour line 20.

Figure 7:
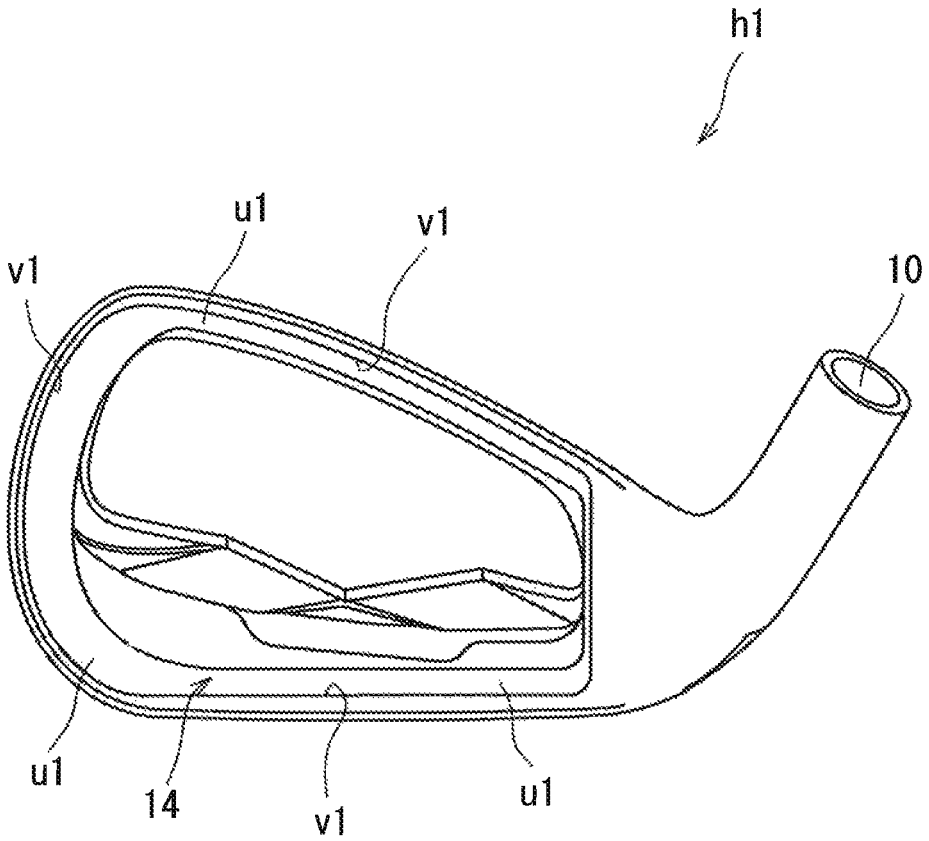
FIG. 7 is a front view of a head body according to the head of FIG. 1.

FIG. 7 is a front view of the head body h1. The head body h1 has an opening part 14. The contour of the opening part 14 is substantially equal to the contour of the face plate p1.

The head body h1 includes a receiving surface u1 which supports the plate back surface b1 of the face plate p1, and a body side surface v1 which is opposed to the plate side surface s1. The whole receiving surface u1 is constituted by a single plane. The receiving surface u1 is provided over the whole circumference of the opening part 14. The body side surface v1 is provided over the whole circumference of the face plate p1. A part of the plate back surface b1 is brought into contact with the receiving surface u1. In FIG. 7, the description of a plastic deforming part d1 (to be described later) is omitted.

Figure 8:
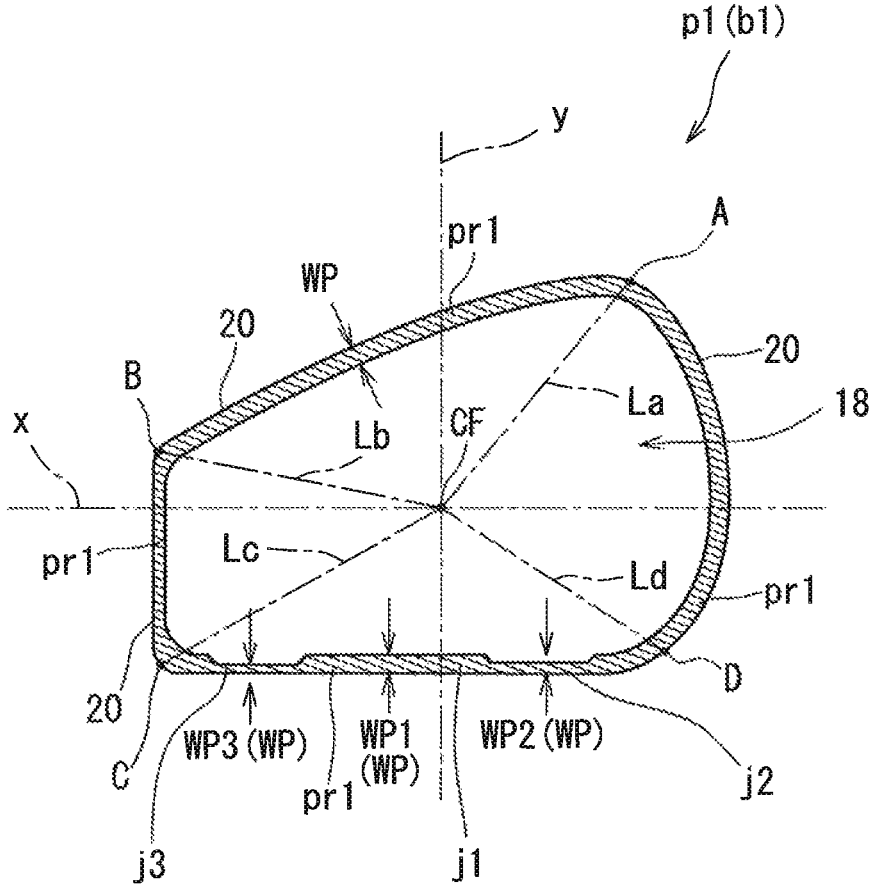
FIG. 8 is the same back view as FIG. 6, and a projection part is shown by hatching in FIG. 8.

FIG. 8 shows the plate back surface b1 as in FIG. 6. In FIG. 8, the projection part pr1 is shown by hatching. The projection part pr1 includes the contour line 20. That is, the outer contour line of the projection part pr1 is the contour line 20.

The plate thickness of the projection part pr1 is greater than the plate thickness of the inner side part 18. As shown in FIG. 8, the projection part pr1 is provided over the whole circumference of the face plate p1. The projection part pr1 abuts on the head body h1. The plate back surface b1 excluding the projection part pr1 does not abut on the head body h1.

A projection part corresponding to the projection part pr1 can also be provided on the head body h1. However, when the specific gravity of the head body h1 is greater than the specific gravity of the face plate p1, the setting of the projection part leads to an increase in a head weight. In addition, the shape of the head body h1 is more complicated than the shape of the face plate p1, which is less likely to subject the head body h1 to a process (for example, NC process). The face plate p1 has a plate shape, which is easily processed.

A center of figure of the plate back surface b1 is shown by reference character CF in FIG. 8. The center of figure CF is determined based on the contour line 20 of the plate back surface b1.

In the plan view of FIG. 8, a straight line x and a straight line y are defined. The straight line x is a straight line passing through the center of figure CF and being parallel to the toe-heel direction. The straight line y is a straight line passing through the center of figure CF and being parallel to the up-down direction.

As shown in FIG. 8, the contour line 20 is sectioned into four by the straight line x and the straight line y. A point having the minimum curvature radius is determined in each of these four sections. A point having the smallest curvature radius in a toe upper side section is shown by reference character A. A point having the smallest curvature radius in a heel upper side section is shown by reference character B. A point having the smallest curvature radius in a heel lower side section is shown by reference character C. A point having the smallest curvature radius in a toe lower side section is shown by reference character D. A straight line which connects the point A and the center of figure CF is a straight line La. A straight line which connects the point B and the center of figure CF is a straight line Lb. A straight line which connects the point C and the center of figure CF is a straight line Lc. The straight line which connects the point D and the center of figure CF is a straight line Ld.

The head 2 may be comparted into four by three-dimensionally enlarging these straight lines. A plane Pa including the straight line La and being perpendicular to the hitting face, a plane Pb including the straight line Lb and being perpendicular to the hitting face, a plane Pc including the straight line Lc and being perpendicular to the hitting face, and a plane Pd including the straight line Ld and being perpendicular to the hitting face are defined (see FIG. 3). The head 2 is comparted into a toe-side region, a heel-side region, a top-side region, and a sole-side region by these four planes Pa, Pb, Pc, and Pd. Therefore, for example, each of the head body h1 and the face plate p1 is also comparted into the toe-side region, the heel-side region, the top-side region, and the sole-side region. Thus, the four regions (toe-side region, heel-side region, top-side region, and sole-side region) in the present application are defined. The toe-side region, the heel-side region, the top-side region, and the sole-side region are generically referred to as a four-section region.

The four-section region is applied to all the portions of the head 2. For example, the projection part pr1 is sectioned into the toe-side region, the heel-side region, the top-side region, and the sole-side region. For example, the plate side surface s1 is sectioned into the toe-side region, the heel-side region, the top-side region, and the sole-side region. For example, the receiving surface u1 is sectioned into the toe-side region, the heel-side region, the top-side region, and the sole-side region. For example, the body side surface v1 is sectioned into the toe-side region, the heel-side region, the top-side region, and the sole-side region.

In the present application, the projection part pr1 is comparted into a first section SG1 and a second section SG2. The first section SG1 is a portion including the toe-side region, the top-side region, and the sole-side region. The second section SG2 is the heel-side region. Therefore, the boundary between the first section SG1 and the second section SG2 is a plane Pb and a plane Pc which are shown in FIG. 3.

Figure 9:
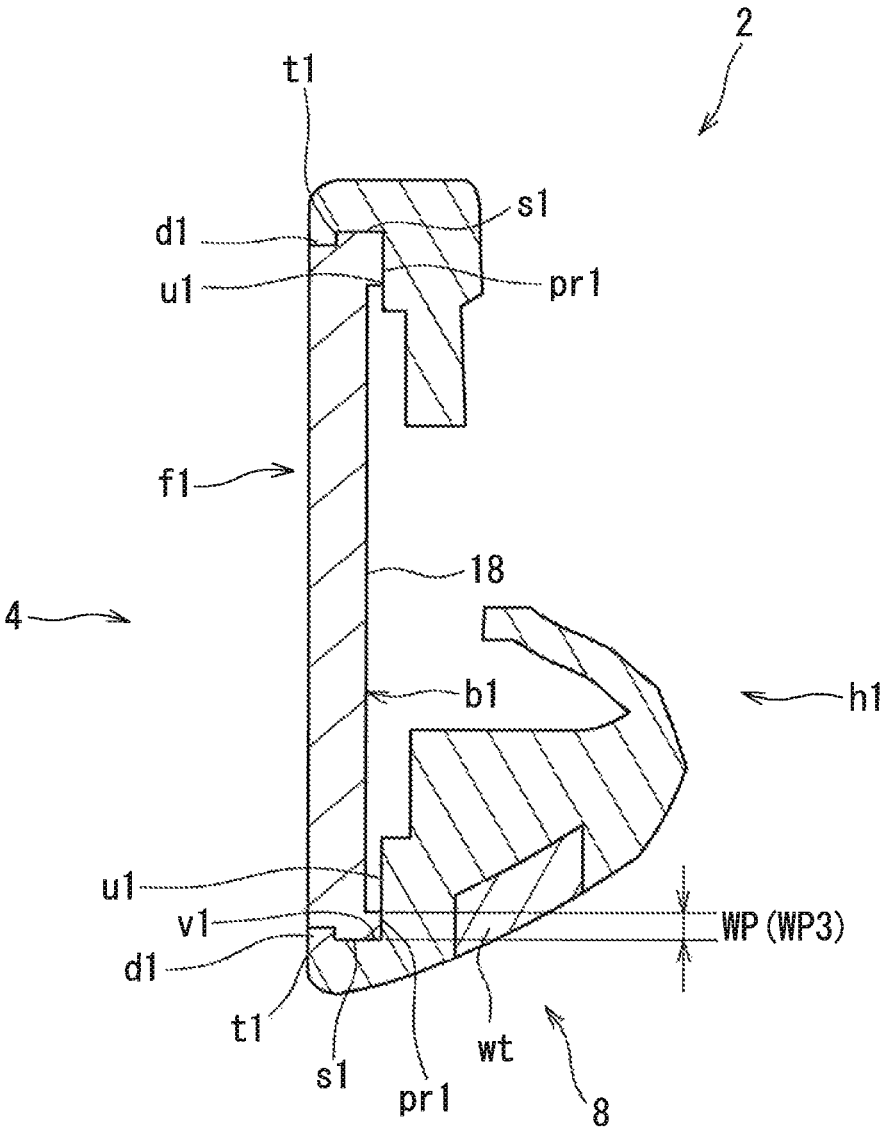
FIG. 9 is a sectional view taken along line F9-F9 of FIG. 3.
Figure 10:
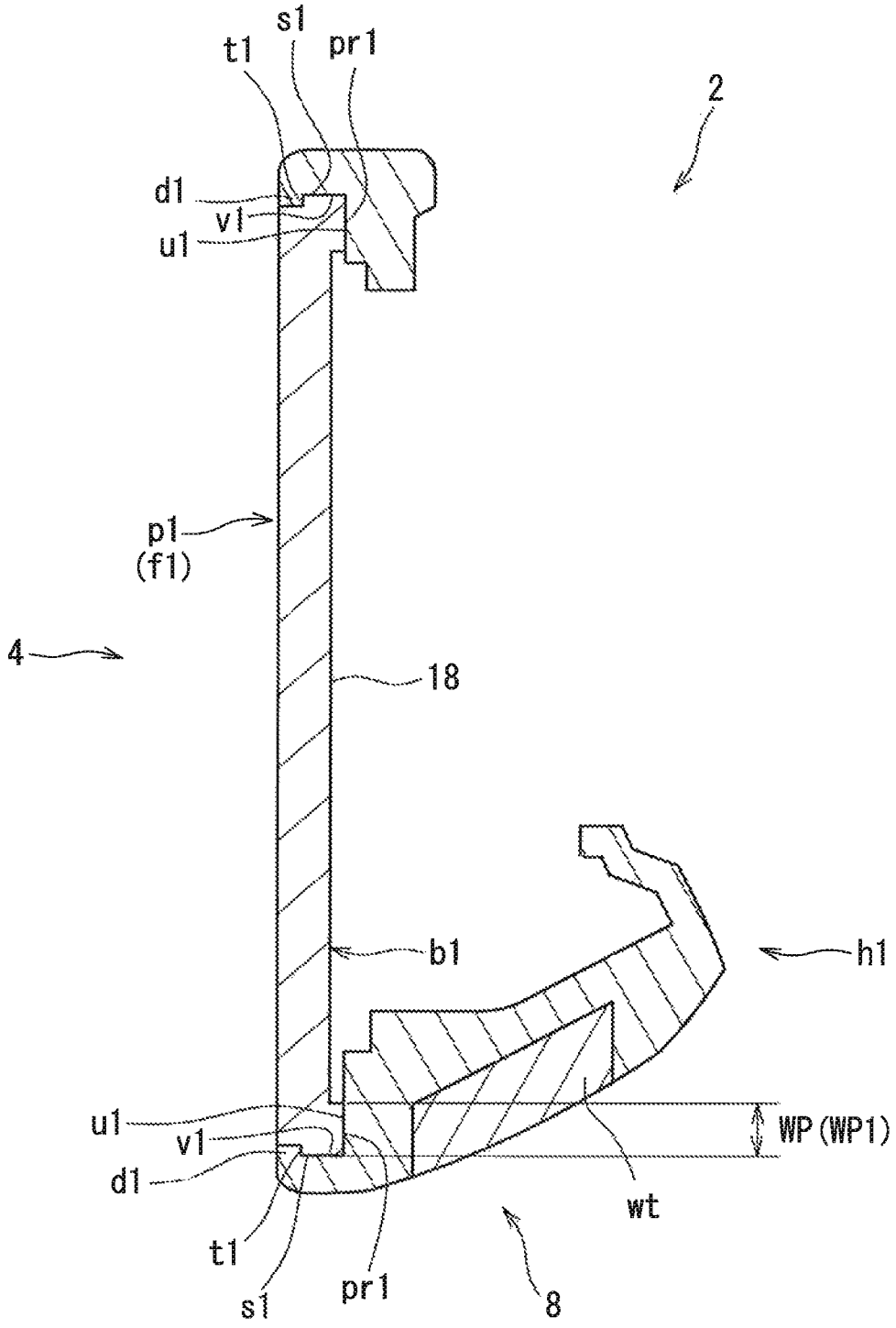
FIG. 10 is a sectional view taken along line F10-F10 of FIG. 3.
Figure 11:
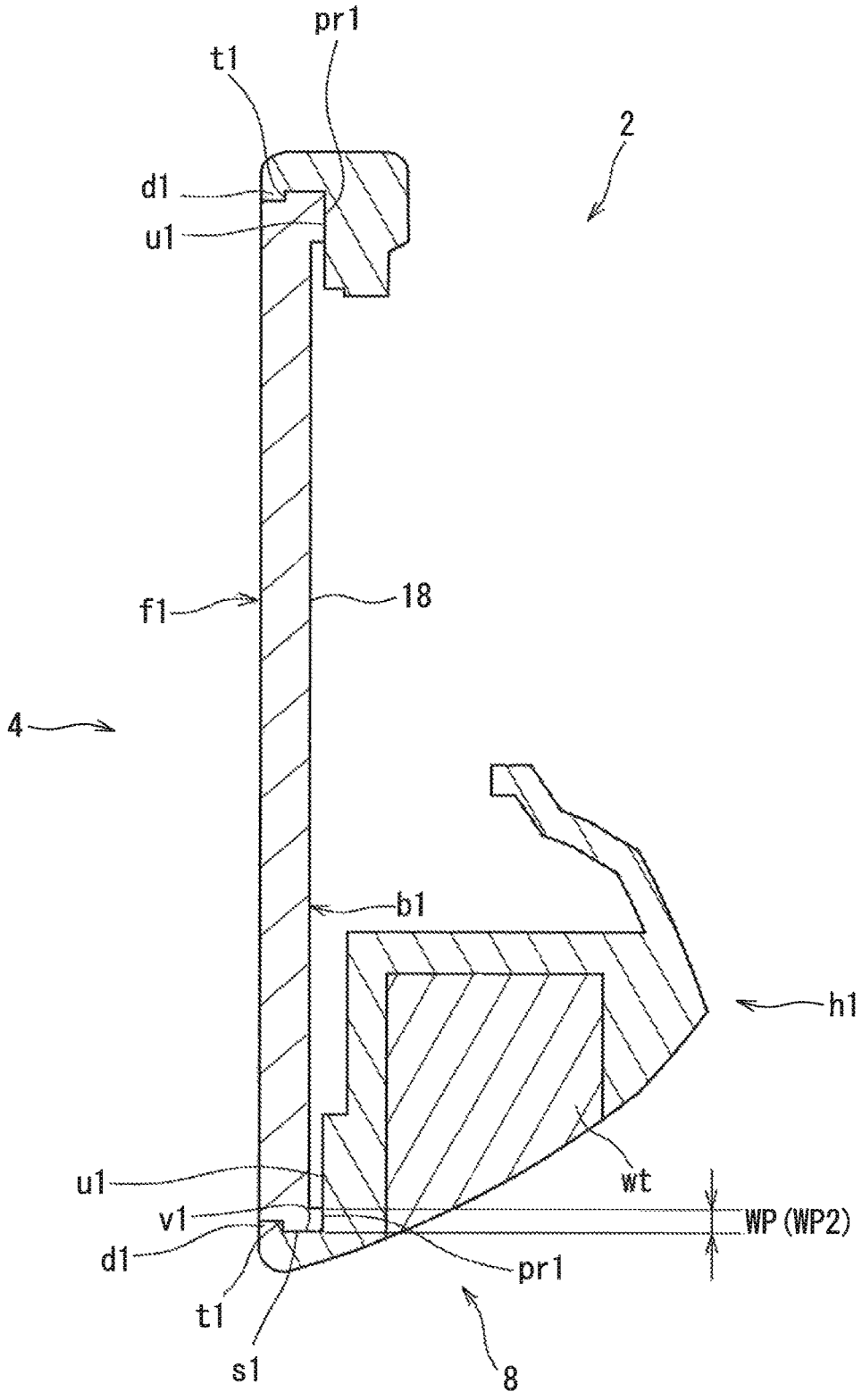
FIG. 11 is a sectional view taken along line F11-F11 of FIG. 3.

FIG. 9 is a sectional view taken along line F9-F9 of FIG. 3. FIG. 10 is a sectional view taken along line F10-F10 of FIG. 3. FIG. 11 is a sectional view taken along line F11-F11 of FIG. 3.

As shown in FIGS. 9, 10, and 11, the projection part pr1 abuts on the receiving surface u1. Meanwhile, the inner side part 18 does not abut on the receiving surface u1.

As shown in FIGS. 9, 10, and 11, the head body h1 includes the plastic deforming part d1. The plastic deforming part d1 is located at front of the face plate p1. In more detail, the plastic deforming part d1 is located at front of a level difference surface t1.

Figure 12A:
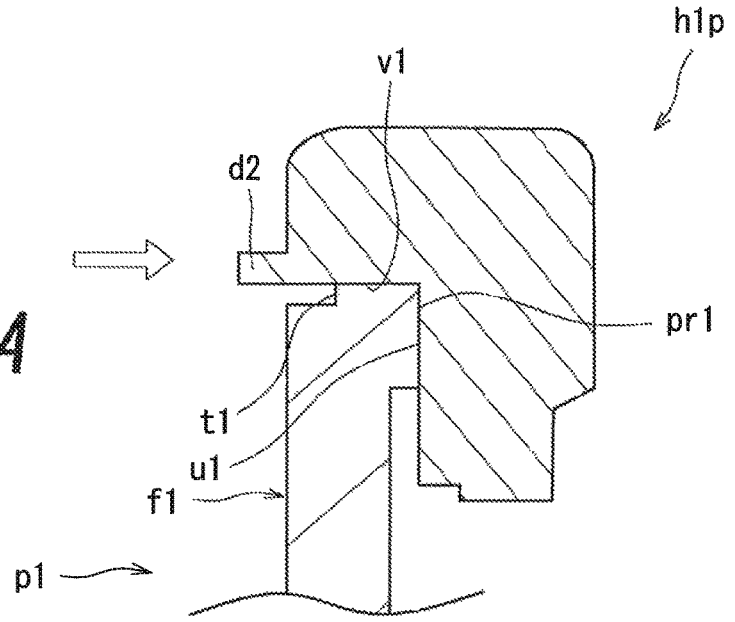
FIG. 12A and FIG. 12B illustrate the procedure of forming a plastic deforming part (caulking step)
Figure 12B:
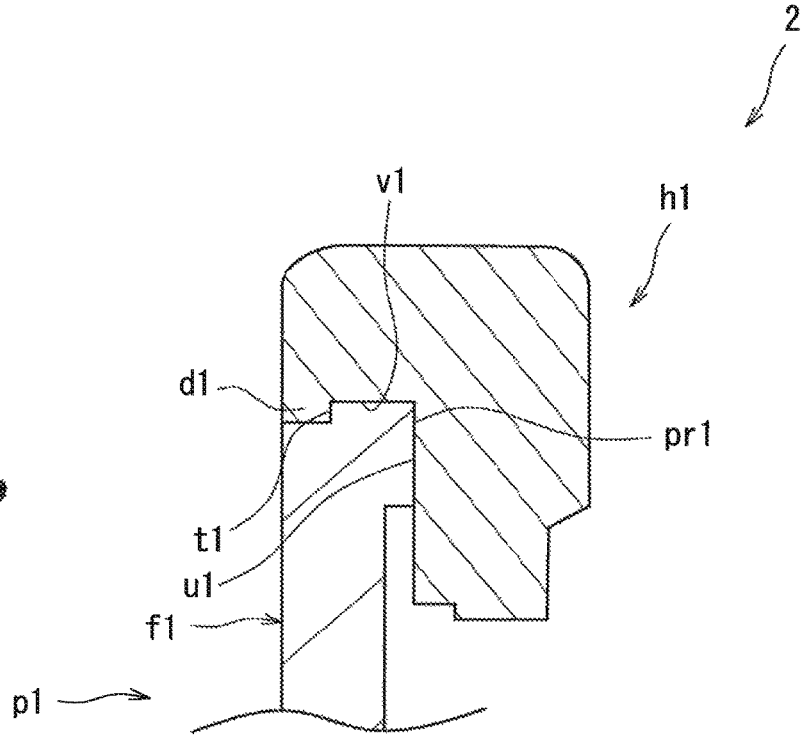

FIG. 12A and FIG. 12B show the procedure of the formation of the plastic deforming part d1.

As shown in FIG. 5 and FIG. 12A, a peripheral part of the plate front surface f1 includes a level difference surface t1 which is located at rear with respect to the hitting face (face 4). As shown in FIG. 5, the level difference surface t1 is provided over the whole circumference of the face plate p1. As shown in FIG. 12B, the plastic deforming part d1 covers front of the level difference surface t1. The plastic deforming part d1 entirely covers level difference surface t1 provided over the whole circumference of the plate front surface f1.

From the viewpoint of fixing the face plate p1, a width Wt1 (see FIG. 5) of the level difference surface t1 is preferably equal to or greater than 0.2 mm, and more preferably equal to or greater than 0.3 mm. In light of the formation of the plastic deforming part d1, the width Wt1 is preferably equal to or less than 2 mm, and more preferably equal to or less than 1 mm.

In a method for forming the plastic deforming part d1, first, a head body h1*p* including an undeformed projection d2 (see FIG. 12A) is prepared. The head body h1*p* is also referred to as an undeformed body. As shown in FIG. 12A, the face plate p1 is set in the undeformed body h1*p*. In this stage, a space exists at front of the level difference surface t1. The space forms a groove-like part including the level difference surface t1 as a bottom face. Next, the undeformed projection d2 is crushed by a jig having a plane parallel to the hitting face. The undeformed projection d2 and its circumference part are plastic-deformed. At least a part of the plastic-deformed portion moves to a space located at front of the level difference surface t1. As a result, at least a part of the space located at front of the level difference surface t1 is filled, which provides the formation of the plastic deforming part d1. The step is also referred to as a caulking step. The plastic deforming part d1 is also referred to as a caulking part.

Such a process method may cause a stress to remain in the plastic deforming part d1. The plastic deforming part d1 may press the face plate p1. The plastic deforming part d1 may press the level difference surface t1.

Since the plastic deforming part d1 is located at front of the face plate p1, the plastic deforming part d1 physically prevents the face plate p1 from coming off to front. Furthermore, since the plastic deforming part d1 is formed by plastic deformation, the plastic deforming part d1 presses the face plate p1. The plastic deforming part d1 contributes to the fixation of the face plate p1.

In the present embodiment, the undeformed projection d2 is provided over the whole circumference of the opening part 14. The process is entirely applied to the undeformed projection d2. As a result, the plastic deforming part d1 is provided over the whole circumference of the face plate p1.

The width of the projection part pr1 is shown by a double-pointed arrow WP in FIG. 8. The width WP is measured in the planar view of the plate back surface b1 (FIG. 8). The width WP is measured along a direction orthogonal to the contour line 20. Therefore, when the contour line 20 is a curve line, the width WP at a point T on the contour line 20 is measured along a direction perpendicular to a tangent at the point T.

In the projection part pr1, the width WP is varied in the sole-side region. The projection part pr1 includes a first portion j1 having a first width WP1, a second portion j2 having a second width WP2, and a third portion j3 having a third width WP3 in the sole-side region. The first width WP1 is greater than the second width WP2. The first width WP1 is greater than the third width WP3. The second width WP2 may be the same as the third width WP3. The second width WP2 may be different from the third width WP3. In the head 2, the width WP of the projection part pr1 is varied in the sole-side region.

The first portion j1 includes the same position in a toe-heel direction as the center of figure CF. The first portion j1 is also referred to as a center disposing part. The second portion j2 is located on a toe side with respect to the center of figure CF. The second portion j2 is also referred to as a toe disposing part. The third portion j3 is located on a heel side with respect to the center of figure CF. The third portion j3 is also referred to as a heel disposing part.

Thus, in the head 2, the projection part pr1 includes the center disposing part j1 including the same position in a toe-heel direction as the center of figure CF, the toe disposing part j2 located on a toe side with respect to the center of figure CF, and the heel disposing part j3 located on a heel side with respect to the center of figure CF. The width WP1 of the center disposing part j1 is greater than the width WP2 of the toe disposing part j2. The width WP1 of the center disposing part j1 is greater than the width WP3 of the heel disposing part j3. Furthermore, the constitution is realized in the sole-side region.

The sole-side region is included in the above-mentioned first section SG1. Therefore, in the head 2, the width WP of the projection part pr1 is varied in the first section SG1.

In the embodiment of FIG. 8, the average width of the projection part pr1 in the heel-side region is different from the average width of the projection part pr1 in the toe-side region. The average width of the projection part pr1 in the heel-side region is different from the average width of the projection part pr1 in the top-side region. The average width of the projection part pr1 in the heel-side region is different from the average width of the projection part pr1 in the sole-side region. The average width of the projection part pr1 in the sole-side region is different from the average width of the projection part pr1 in the top-side region. The average width of the projection part pr1 in the sole-side region is different from the average width of the projection part pr1 in the toe-side region.

In the embodiment of FIG. 8, the average width of the projection part pr1 in the heel-side region is smaller than the average width of the projection part pr1 in the toe-side region. The average width of the projection part pr1 in the heel-side region is smaller than the average width of the projection part pr1 in the top-side region. The average width of the projection part pr1 in the heel-side region is smaller than the average width of the projection part pr1 in the sole-side region. The average width of the projection part pr1 in the sole-side region is smaller than the average width of the projection part pr1 in the top-side region. The average width of the projection part pr1 in the sole-side region is smaller than the average width of the projection part pr1 in the toe-side region.

The average width can be calculated by dividing the whole area by the length of the contour line 20. For example, if the area of the sole-side region of the projection part pr1 is defined as S; the length of the contour line 20 in the sole-side region is defined as L; and the average width of the projection part pr1 in the sole-side region is defined as Wz, the average width Wz can be calculated by the following formula.

$$Wz=S/L$$

Figure 13A:
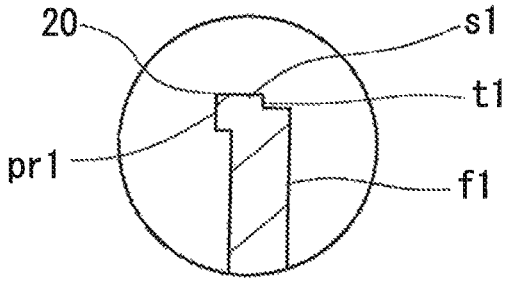
FIG. 13A is a sectional view taken along line 13A-13A in FIG. 13.
Figure 13:
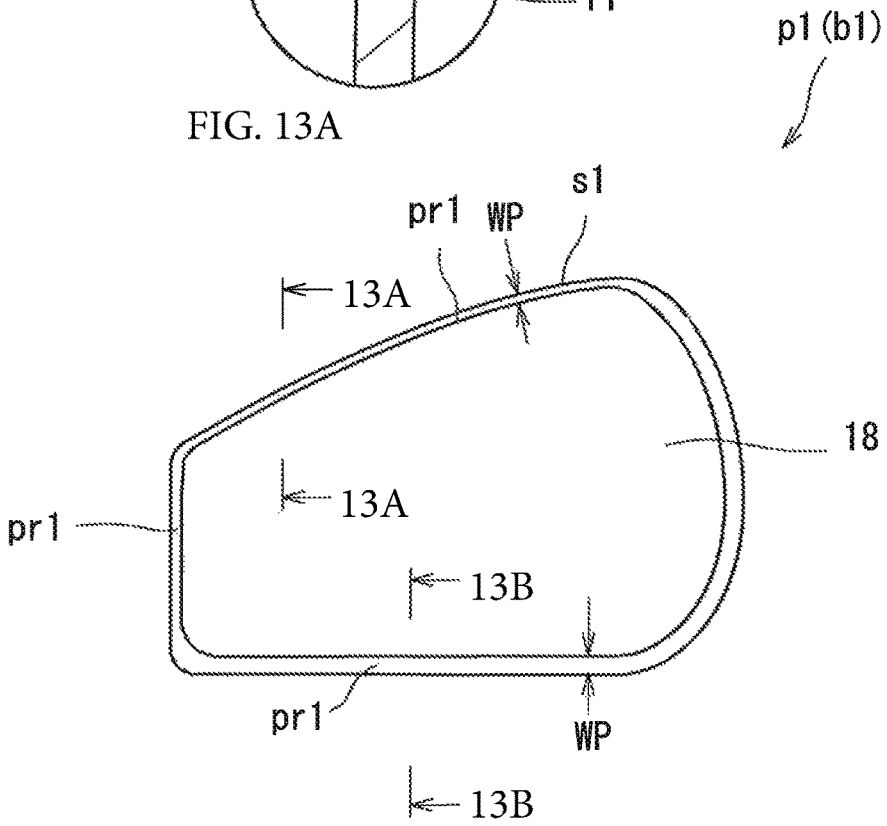
FIG. 13 is a back view of a face plate according to a second embodiment.
Figure 13B:
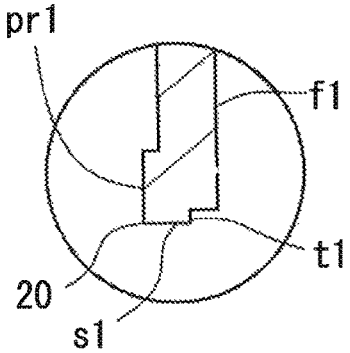
FIG. 13B is a sectional view taken along line 13B-13B in FIG. 13.

FIG. 13 is a back view of a face plate p1 according to a second embodiment. FIG. 13A is a sectional view taken along line 13A-13A in FIG. 13. FIG. 13B is a sectional view taken along line 13B-13B in FIG. 13. In the embodiment, a width WP of a projection part pr1 in a top-side region is small. The average width of the projection part pr1 in the top-side region is smaller than the average width of the projection part pr1 in a heel-side region. The average width of the projection part pr1 in the top-side region is smaller than the average width of the projection part pr1 in a sole-side region. The average width of the projection part pr1 in the top-side region is smaller than the average width of the projection part pr1 in a toe-side region. The average width of the projection part pr1 in the heel-side region is smaller than the average width of the projection part pr1 in the toe-side region. The average width of the projection part pr1 in the heel-side region is smaller than the average width of the projection part pr1 in the sole-side region.

Figure 14A:
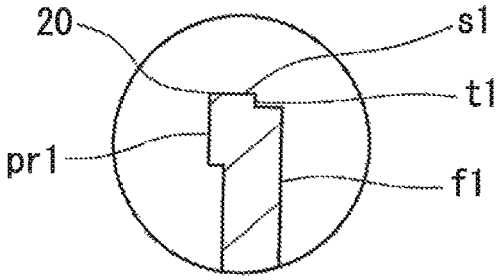
FIG. 14A is a sectional view taken along line 14A-14A in FIG. 14.
Figure 14:
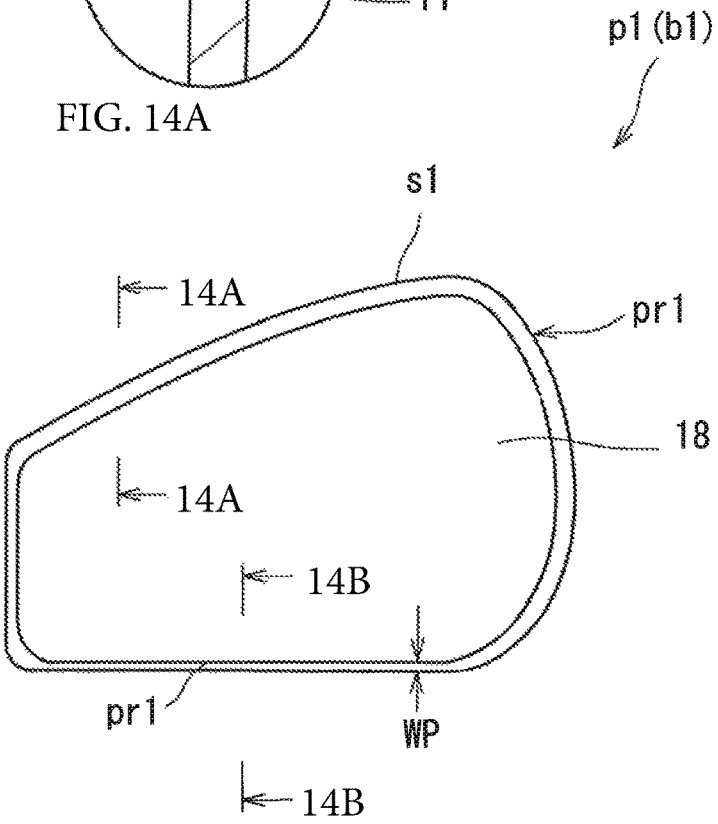
FIG. 14 is a back view of a face plate according to a third embodiment.
Figure 14B:
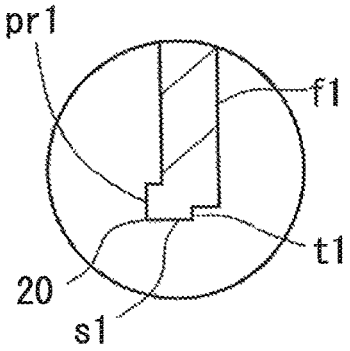
FIG. 14B is a sectional view taken along line 14B-14B in FIG. 14.

FIG. 14 is a back view of a face plate p1 according to a third embodiment. FIG. 14A is a sectional view taken along line 14A-14A in FIG. 14. FIG. 14B is a sectional view taken along line 14B-14B in FIG. 14. In the embodiment, a width WP of a projection part pr1 in a sole-side region is small. The average width of the projection part pr1 in the sole-side region is smaller than the average width of the projection part pr1 in a heel-side region. The average width of the projection part pr1 in the sole-side region is smaller than the average width of the projection part pr1 in a top-side region. The average width of the projection part pr1 in the sole-side region is smaller than the average width of the projection part pr1 in a toe-side region. The average width of the projection part pr1 in the heel-side region is smaller than the average width of the projection part pr1 in the toe-side region. The average width of the projection part pr1 in the heel-side region is smaller than the average width of the projection part pr1 in the top-side region.

Figure 15A:
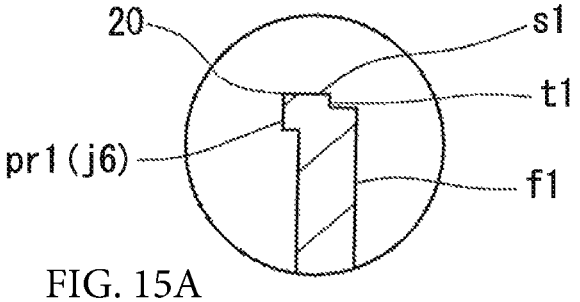
FIG. 15A is a sectional view taken along line 15A-15A in FIG. 15.
Figure 15:
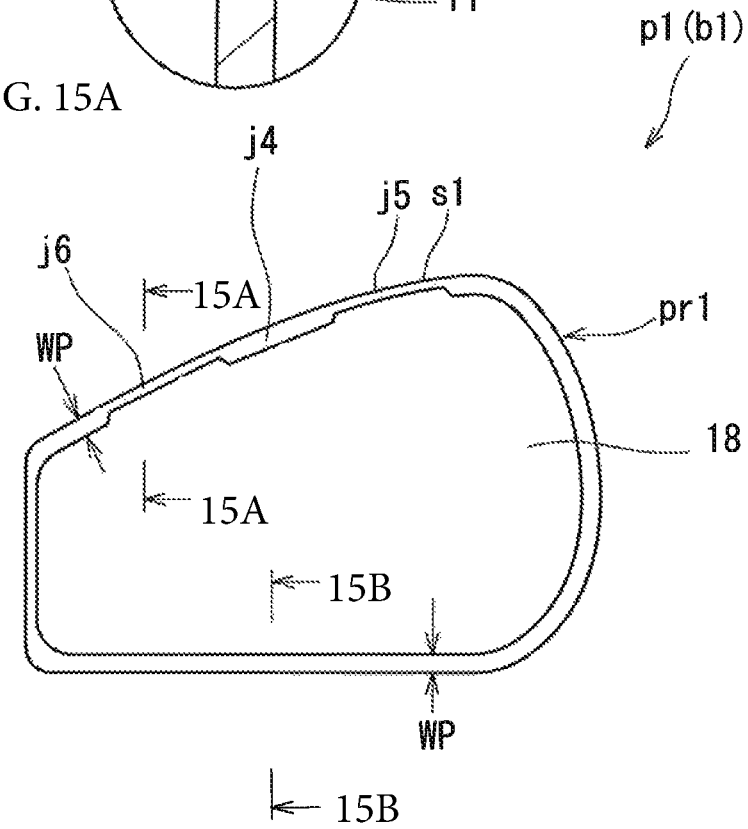
FIG. 15 is a back view of a face plate according to a fourth embodiment.
Figure 15B:
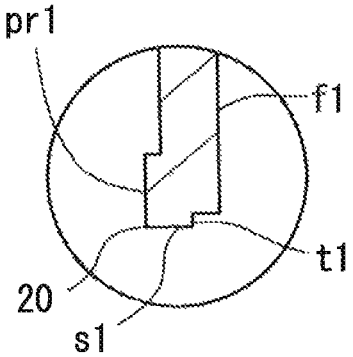
FIG. 15B is a sectional view taken along line 15B-15B in FIG. 15.

FIG. 15 is a back view of a face plate p1 according to a fourth embodiment. FIG. 15A is a sectional view taken along line 15A-15A in FIG. 15. FIG. 15B is a sectional view taken along line 15B-15B in FIG. 15. In the embodiment, a width WP is varied in a top-side region.

In the top-side region, a projection part pr1 includes a center disposing part j4, a toe disposing part j5, and a heel disposing part j6. The center disposing part j4 includes the same position in a toe-heel direction as a center of figure CF. The heel disposing part j6 is located on a heel side with respect to the center of figure CF. The toe disposing part j5 is located on a toe side with respect to the center of figure CF. The width WP of the center disposing part j4 is greater than the width WP of the heel disposing part j6. The width WP of the center disposing part j4 is greater than the width WP of the toe disposing part j5.

In the embodiment, the average width of a projection part pr1 in a heel-side region is smaller than the average width of the projection part pr1 in a toe-side region. The average width of the projection part pr1 in the heel-side region is smaller than the average width of the projection part pr1 in a top-side region. The average width of the projection part pr1 in the heel-side region is smaller than the average width of the projection part pr1 in a sole-side region. The average width of the projection part pr1 in the top-side region is smaller than the average width of the projection part pr1 in the sole-side region. The average width of the projection part pr1 in the top-side region is smaller than the average width of the projection part pr1 in the toe-side region.

Figure 16:
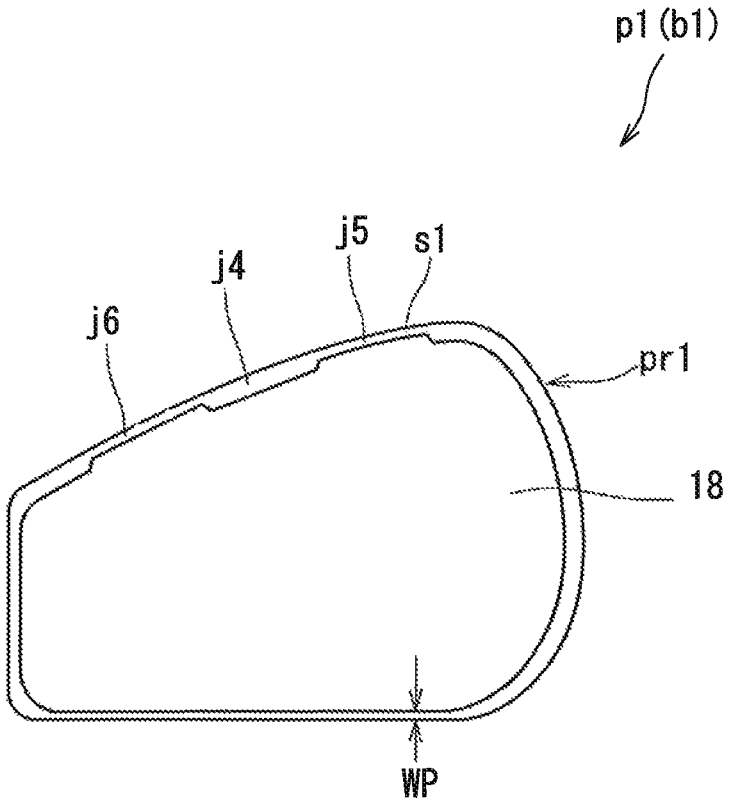
FIG. 16 is a back view of a face plate according to a fifth embodiment.

FIG. 16 is a back view of a face plate p1 according to a fifth embodiment. In the embodiment, a width WP is varied in a top-side region. Furthermore, the width WP in a sole-side region is small.

In the top-side region, a projection part pr1 includes a center disposing part j4, a toe disposing part j5, and a heel disposing part j6. The center disposing part j4 includes the same position in a toe-heel direction as a center of figure CF. The heel disposing part j6 is located on a heel side with respect to the center of figure CF. The toe disposing part j5 is located on a toe side with respect to the center of figure CF. The width WP of the center disposing part j4 is greater than a width WP of the heel disposing part j6. The width WP of the center disposing part j4 is greater than the width WP of the toe disposing part j5.

In the embodiment, the average width of the projection part pr1 in a heel-side region is smaller than the average width of the projection part pr1 in a toe-side region. The average width of the projection part pr1 in the heel-side region is smaller than the average width of the projection part pr1 in a top-side region. The average width of the projection part pr1 in the sole-side region is smaller than the average width of the projection part pr1 in the heel-side region. The average width of the projection part pr1 in the sole-side region is smaller than the average width of the projection part pr1 in the toe-side region. The average width of the projection part pr1 in the sole-side region is smaller than the average width of the projection part pr1 in the top-side region.

Figure 17:
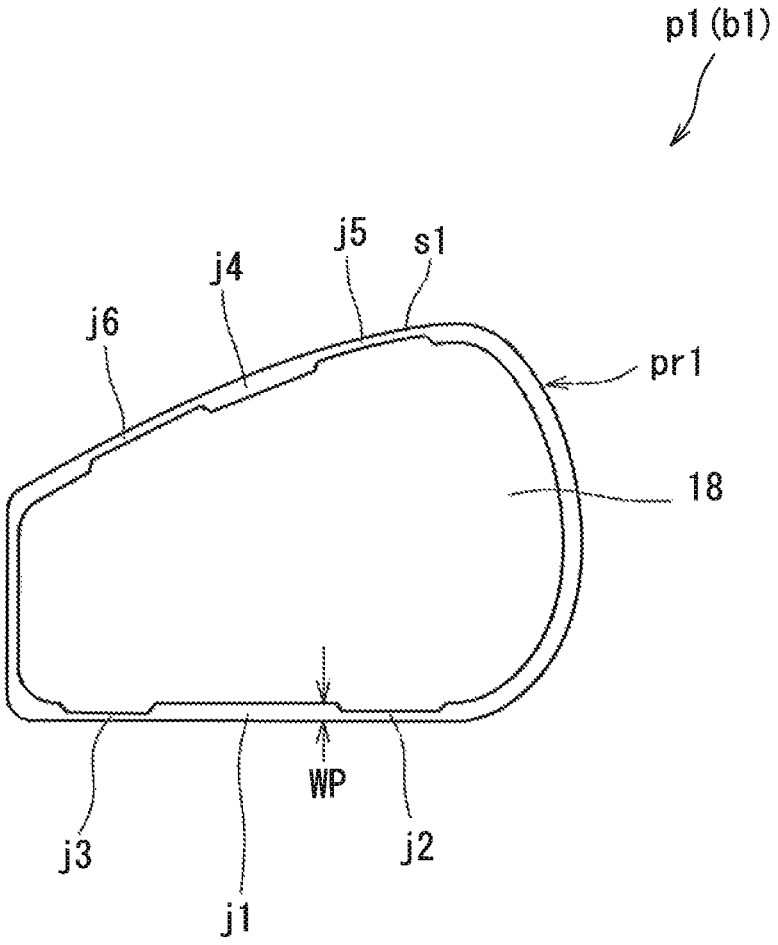
FIG. 17 is a back view of a face plate according to a sixth embodiment.

FIG. 17 is a back view of a face plate p1 according to a sixth embodiment. In the embodiment, a width WP is varied in a top-side region. Furthermore, in the embodiment, the width WP is varied in a sole-side region.

In the sole-side region, a projection part pr1 includes a first center disposing part j1, a first toe disposing part j2, and a first heel disposing part j3. The first center disposing part j1 includes the same position in a toe-heel direction as a center of figure CF. The first toe disposing part j2 is located on a toe side with respect to the center of figure CF. The first heel disposing part j3 is located on a heel side with respect to the center of figure CF. The width WP of the first center disposing part j1 is greater than the width WP of the first toe disposing part j2. The width WP of the first center disposing part j1 is greater than the width WP of the first heel disposing part j3.

In the top-side region, the projection part pr1 includes a second center disposing part j4, a second toe disposing part j5, and a second heel disposing part j6. The second center disposing part j4 includes the same position in a toe-heel direction as the center of figure CF. The second toe disposing part j5 is located on a toe side with respect to the center of figure CF. The second heel disposing part j6 is located on a heel side with respect to the center of figure CF. The width WP of the second center disposing part j4 is greater than the width WP of the second toe disposing part j5. The width WP of the second center disposing part j4 is greater than the width WP of the second heel disposing part j6.

At least a part of the position in a toe-heel direction of the first center disposing part j1 overlaps with the position in a toe-heel direction of the second center disposing part j4. At least a part of the position in a toe-heel direction of the first toe disposing part j2 overlaps with the position in a toe-heel direction of the second toe disposing part j5. At least a part of the position in a toe-heel direction of the first heel disposing part j3 overlaps with the position in a toe-heel direction of the second heel disposing part j6.

Figure 18:
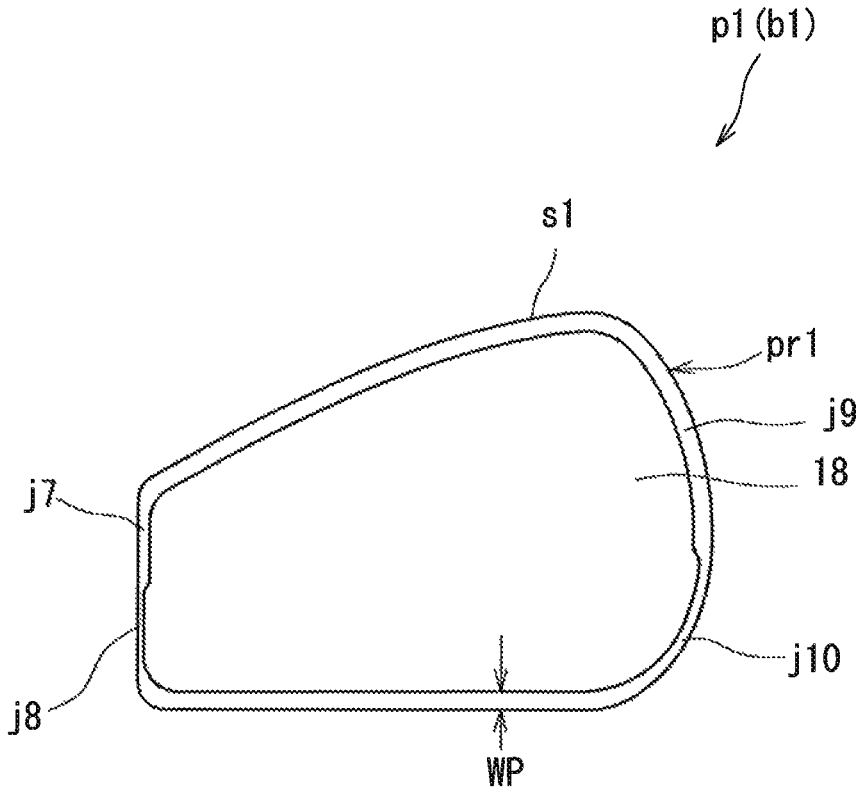
FIG. 18 is a back view of a face plate according to a seventh embodiment.

FIG. 18 is a back view of a face plate p1 according to a seventh embodiment. In the embodiment, a width WP is varied in a heel-side region. Furthermore, in the embodiment, the width WP is varied in a toe-side region.

In the heel-side region, a projection part pr1 includes an upper disposing part j7 and a lower disposing part j8 located below the upper disposing part j7. The width WP of the lower disposing part j8 is smaller than the width WP of the upper disposing part j7. The average value of the width WP of the lower disposing part j8 is smaller than the average value of the width WP of the upper disposing part j7.

In the toe-side region, the projection part pr1 includes an upper disposing part j9 and a lower disposing part j10 located below the upper disposing part j9. The width WP of the lower disposing part j10 is smaller than the width WP of the upper disposing part j9. The average value of the width WP of the lower disposing part j10 is smaller than the average value of the width WP of the upper disposing part j9.

At least a part of the up-down direction position of the upper disposing part j7 overlaps with the up-down direction position of the upper disposing part j9. At least a part of the up-down direction position of the lower disposing part j8 overlaps with the up-down direction position of the lower disposing part j10.

The embodiment satisfies the following (a) and (b). Only any one of (a) or (b) may be satisfied.

(a) The width WP of the projection part pr1 in the heel-side region is varied, and a portion of which the width WP is minimal is located below the center of figure CF.

(b) The width WP of the projection part pr1 in the toe-side region is varied, and a portion of which the width WP is minimal is located below the center of figure CF.

As described above, in each of the embodiments, the width WP of the projection part pr1 is varied in the first section SG1. That is, in the first section SG1, a portion of which the width WP is comparatively small, and a portion of which the width WP is comparatively large exist.

If the width WP is small, an area in which the thickness (plate thickness) of the face plate p1 is small is enlarged. Furthermore, if the width WP is small, a contact area between the plate back surface b1 of the face plate p1 and the head body h1 is decreased, which decreases the restraint of the face plate p1 caused by the head body h1. These promote the deformation of the face plate p1 in hitting a ball. The small width WP promotes the elastic deformation of the face plate p1 in hitting the ball. Restitution performance can be improved in a site of which the width WP is small.

Meanwhile, restitution performance is suppressed in a site of which the width WP is large. By increasing the width WP, an area in which the thickness of the face plate p1 is large is enlarged, which improves durability.

In the first embodiment of FIG. 6 (FIG. 8), the center disposing part j1 improves the durability of a face central part on which hit points are concentrated. In addition, the toe disposing part j2 and the heel disposing part j3 which have the small width WP improve restitution performance when the hit point is displaced to the toe side and the heel side. In the head 2, the restitution performance on the toe side and the heel side of the face central part can be brought closer to the restitution performance of the face central part. Therefore, a variation in a flight distance caused by a variation in the hit point is suppressed. Furthermore, since the average width of the projection part pr1 in the sole-side region is small, restitution performance when the hit point is displaced to the lower side is improved. Particularly, restitution performance when the hit point is displaced to the toe lower side or a heel lower side is improved.

In the first embodiment, the width WP of the center disposing part j1 is set to 1 mm or greater but 8 mm or less, for example. In the first embodiment, the widths WP of the toe disposing part j2 and the heel disposing part j3 are set to 0.5 mm or greater but 5 mm or less, for example.

In the second embodiment of FIG. 13, the width WP of the top-side region is small. For this reason, the top-side weight of the face plate p1 is decreased, which can lower the center of gravity of the head. In addition, restitution performance when the hit point is displaced to the upper side is improved.

In the second embodiment, the width WP of the projection part pr1 in the top-side region is set to 0.5 mm or greater but 4 mm or less, for example. In the second embodiment, the width WP of the projection part pr1 in the sole-side region is set to 1 mm or greater and 8 mm or less, for example.

In the third embodiment of FIG. 14, the width WP of the sole-side region is small. For this reason, restitution performance when the hit point is displaced to the lower side is improved. An iron mostly hits a ball on grass without teeing up the ball. In the iron, the hit point is apt to be on the lower side (closer to the sole). The third embodiment improves the restitution performance on the lower side on which the hit points are comparatively apt to be concentrated.

In the third embodiment, the width WP of the projection part pr1 in the top-side region is set to 1 mm or greater but 8 mm or less, for example. In the third embodiment, the width WP of the projection part pr1 in the sole-side region is set to 0.5 mm or greater but 6 mm or less, for example.

In the fourth embodiment of FIG. 15, the center disposing part j4 improves the durability of a face central part on which the hit points are concentrated. In addition, the toe disposing part j5 and the heel disposing part j6 which have the small width WP improve restitution performance when the hit point is displaced to the toe side and the heel side. For this reason, the restitution performance on the toe side and the heel side of the face central part can be brought closer to the restitution performance of the face central part. As a result, a variation in a flight distance caused by a variation in the hit point is suppressed. Furthermore, since the average width of the projection part pr1 in the top-side region is small, restitution performance when the hit point is displaced to the upper side is improved. Particularly, restitution performance when the hit point is displaced to a toe upper side or a heel upper side is improved.

In the fourth embodiment, the width WP of the center disposing part j4 is set to 1 mm or greater but 8 mm or less, for example. In the fourth embodiment, the widths WP of the toe disposing part j5 and the heel disposing part j6 are set to 0.5 mm or greater but 5 mm or less, for example.

In the fifth embodiment of FIG. 16, an effect provided by the small width WP of the sole-side region is obtained in addition to the effect in the fourth embodiment of FIG. 15. In the fifth embodiment, restitution performance when the hit point is displaced to the lower side is improved. As described above, in the iron, the hit point is apt to be on the lower side (closer to the sole). The fifth embodiment improves the restitution performance on the lower side on which the hit points are comparatively apt to be concentrated.

In the fifth embodiment, the width WP of the center disposing part j4 is set to 1 mm or greater but 8 mm or less, for example. In the fifth embodiment, the widths WP of the toe disposing part j5 and the heel disposing part j6 are set to 0.5 mm or greater but 5 mm or less, for example. In the fifth embodiment, the width WP of the projection part pr1 in the sole-side region is set to 0.5 mm or greater but 5 mm or less, for example.

In the sixth embodiment of FIG. 17, the first center disposing part j1 and the second center disposing part j4 improve the durability of a face central part on which hit points are concentrated. In addition, the first toe disposing part j2 and the second toe disposing part j5 which have the small width WP, and the first heel disposing part j3 and the second heel disposing part j6 which have the small width WP improve restitution performance when the hit point is displaced to the toe side and the heel side. For this reason, the restitution performance on the toe side and the heel side can be brought closer to the restitution performance of the face central part. As a result, a variation in a flight distance caused by a variation in the hit point is further suppressed.

In the seventh embodiment of FIG. 18, the lower disposing part j8 which has the small width WP improves restitution performance when the hit point is displaced to the lower side. As described above, in the iron, the hit point is apt to be on the lower side (closer to the sole). The lower disposing part j8 improves the restitution performance on the lower side on which the hit points are comparatively apt to be concentrated. Similarly, the lower disposing part j10 which has the small width WP improves restitution performance when the hit point is displaced to the lower side. The lower disposing part j10 improves the restitution performance on the lower side on which the hit points are comparatively apt to be concentrated. Particularly, the lower disposing part j8 contributes to restitution performance on a heel lower side. Particularly, the lower disposing part j10 contributes to restitution performance on a toe lower side.

In the seventh embodiment, the width WP of the upper disposing part j7 is set to 1 mm or greater but 8 mm or less, for example. In the seventh embodiment, the width WP of the lower disposing part j8 is set to 0.5 mm or greater but 5 mm or less, for example. In the seventh embodiment, the width WP of the upper disposing part j9 is set to 1 mm or greater but 8 mm or less, for example. In the seventh embodiment, the width WP of the lower disposing part j10 is set to 0.5 mm or greater but 5 mm or less, for example.

In the embodiment of FIG. 6 or the like, the width WP of the heel-side region is small, and the width WP of the toe-side region is large. The iron tends to have a hosel portion having an increased weight and a head of which the center of gravity is closer to a heel. By decreasing the width WP of the heel-side region and increasing the width WP of the toe-side region, the center of gravity of the head can be prevented from being closer to the heel. Therefore, the restitution performance when the hit point is displaced to the toe side is improved.

Thus, by providing the portion having the small width WP, the effect according to the position of the portion is obtained. Examples of the disposing constitution of a portion (small width portion) having a width WP smaller than the average width of the whole projection part pr1 include the following (1) to (18). In addition, the following constitution (19) is also exemplified. Two or more selected from these constitutions may be combined.

(1) The small width portion is disposed on the toe side of the center of figure CF and the heel side of the center of figure CF.

(2) The small width portion is disposed above the center of figure CF and below the center of figure CF.

(3) The small width portion is disposed in the top-side region and the sole-side region.

(4) The small width portion is disposed in the toe-side region and the heel-side region.

(5) The small width portion is disposed in one or more selected from the group consisting of the top-side region, the sole-side region, the toe-side region, and the heel-side region.

(6) The small width portion is disposed in two or more selected from the group consisting of the top-side region, the sole-side region, the toe-side region, and the heel-side region.

(7) The small width portion is disposed in three or more selected from the group consisting of the top-side region, the sole-side region, the toe-side region, and the heel-side region.

(8) The small width portion is disposed in each of the top-side region, the sole-side region, the toe-side region, and the heel-side region.

(9) In the top-side region, the small width portion is disposed on the toe side of the center of figure CF and on the heel side of the center of figure CF.

(10) In the sole-side region, the small width portion is disposed on the toe side of the center of figure CF and the heel side of the center of figure CF.

(11) In the toe-side region, the small width portion is disposed below the center of figure CF and above the center of figure CF.

(12) In the heel-side region, the small width portion is disposed below the center of figure CF and above the center of figure CF.

(13) The small width portion is disposed at the first position which is located in the heel-side region and above the center of figure CF, and the second position which is located in the toe-side region and below the center of figure CF.

(14) The small width portion is disposed at the first position which is located in the toe-side region and above the center of figure CF, and the second position which is located in the heel-side region and below the center of figure CF.

(15) The small width portion is disposed at the first position which is located in the top-side region and on a heel side with respect to the center of figure CF, and the second position which is located in the sole-side region and on a toe side with respect to the center of figure CF.

(16) The small width portion is disposed at the first position which is located in the sole-side region and on a heel side with respect to the center of figure CF, and the second position which is located in the top-side region and on a toe side with respect to the center of figure CF.

(17) The small width portion is disposed at the first position which is located in the top-side region and on a heel side with respect to the center of figure CF, and the second position which is located in the sole-side region and on a heel side with respect to the center of figure CF.

(18) The small width portion is disposed at the first position which is located in the top-side region and on a toe side with respect to the center of figure CF, and the second position which is located in the sole-side region and on a toe side with respect to the center of figure CF.

(19) The average width of the projection part pr1 in the first section SG1 is greater than the average width of the projection part pr1 in the second section SG2.

EXAMPLES

Hereinafter, the effects of the present invention will be clarified by Examples. However, the present invention should not be interpreted in a limited way based on the description of Examples.

Example

The same head as the above-mentioned head 2 was produced. A face plate p1 and a head body (undeformed body) h1*p* were prepared. The head body h1*p* was produced by casting. A weight member wt was attached to a sole part of the head body h1*p*. The weight member wt was made of a tungsten nickel alloy. The head body h1*p* included an undeformed projection d2. The undeformed projection d2 was formed on the whole circumference of an opening part 14. The head body h1*p* was made of stainless steel (SUS630). The face plate p1 was cut from a plate material (rolling material). A plate back surface b1 of the face plate p1 was cut by an NC process, to form a desired projection part pr1. Since the face plate p1 was processed, the projection part pr1 was easily formed. The face plate p1 was made of a titanium alloy. As the titanium alloy, Super-TIX (registered trademark) manufactured by Nippon Steel & Sumitomo Metal Corporation was used.

The face plate p1 was fitted into the opening part 14 of the head body h1*p*. Next, by performing the above-mentioned caulking step, the undeformed projection d2 was changed to a plastic deforming part d1. Thus, a head of Example was obtained.

Thus, the projection part pr1 could be easily formed by processing the face plate p1 before being attached to the head body h1*p*.

As described above, the advantages of the present invention are apparent.

The description hereinabove is merely for an illustrative example, and various modifications can be made in the scope not to depart from the principles of the present invention.

The present invention can be applied to all golf club heads such as a wood type head, a utility type head, a hybrid type head, an iron type head, and a putter head.

What is claimed is:

1. A golf club head comprising:

a head body; and a face plate fixed to the head body, wherein:

the face plate includes a plate front surface having a hitting face, a plate back surface which is a surface opposite to the plate front surface, and a plate side surface;

the plate back surface includes a center of figure;

the head body includes a receiving surface which supports the plate back surface from a rear;

an outer peripheral edge part of the plate back surface includes a projection part which abuts on the receiving surface;

the head body further includes:

a body side surface that is opposed to the plate side surface, and the body side surface is provided over a whole circumference of the face plate; and a plastic deforming part, wherein a peripheral part of the plate front surface includes a level difference surface that is located at a rear with respect to the hitting face, and the plastic deforming part is located at a front of the level difference surface, wherein a plate thickness of the projection part is greater than a plate thickness of an inner side part that is located on an inner side of the outer peripheral edge part, and wherein a toe-side region, a top-side region, and a sole-side region of the projection part are defined as a first section, and a heel-side region of the projection part is defined as a second section, and wherein a width of the projection part is varied in the first section.

2. The golf club head according to claim 1, wherein the width of the projection part is varied in the sole-side region.

3. The golf club head according to claim 1, wherein:

the projection part includes a center disposing part located so as to include the toe-heel direction position of the center of figure, a heel disposing part located on a heel side with respect to the center of figure, and a toe disposing part located on a toe side with respect to the center of figure;

a width of the center disposing part is greater than a width of the heel disposing part; and the width of the center disposing part is greater than a width of the toe disposing part.

4. The golf club head according to claim 3, wherein a width of the center disposing part is equal to or greater than 1 mm but equal to or less than 8 mm.

5. The golf club head according to claim 3, wherein a width of the heel disposing part and the toe disposing part are equal to or greater than 0.5 mm but equal to or less than 5 mm.

6. The golf club head according to claim 3, wherein the center disposing part, the heel disposing part and the toe disposing part are located in the sole-side region.

7. The golf club head according to claim 1, wherein an average width of the projection part in the sole-side region is different from an average width of the projection part in the top-side region.

8. The golf club head according to claim 1, wherein an average width of the projection part in the sole-side region is smaller than an average width of the projection part in the top-side region.

9. The golf club head according to claim 8, wherein the average width of the projection part in the sole-side region is equal to or greater than 0.5 mm but equal to or less than 6 mm.

10. The golf club head according to claim 8, wherein the average width of the projection part in the top-side region is equal to or greater than 1 mm but equal to or less than 8 mm.

11. The golf club head according to claim 1, wherein an average width of the projection part in the heel-side region is smaller than an average width of the projection part in the toe-side region.

12. The golf club head according to claim 1, wherein the golf club head satisfies the following (a) and/or (b):

(a) a width of the projection part in the heel-side region is varied, and a portion of which the width is minimal is located below the center of figure, (b) a width of the projection part in the toe-side region is varied, and a portion of which the width is minimal is located below the center of figure.

13. The golf club head according to claim 1, wherein an average width of the projection part in the first section is greater than an average width of the projection part in the second section.

* * * * *